US005172102A

United States Patent [19]

Iwamura et al.

[11] Patent Number: 5,172,102

[45] Date of Patent: Dec. 15, 1992

[54] GRAPHIC DISPLAY METHOD

[75] Inventors: Kazuaki Iwamura, Hachioji; Yasuei Nomoto, Katsuta; Yoshizo Ito, Hitachi, all of Japan

[73] Assignee: Hitachi, Ltd., Tokyo, Japan

[21] Appl. No.: 670,284

[22] Filed: Mar. 15, 1991

[30] Foreign Application Priority Data

Mar. 16, 1990 [JP] Japan ..... 2-64228

[51] Int. Cl.[5] ..... G09G 1/06

[52] U.S. Cl. ..... 340/726; 340/731; 340/729; 358/182

[58] Field of Search ..... 340/726, 724, 731, 728, 340/995, 990, 747, 729; 395/119, 127, 138; 364/474.24; 358/182, 183

[56] References Cited

U.S. PATENT DOCUMENTS

| | | | |
|---|---|---|---|
| 2,240,420 | 4/1941 | Schnitzer | 359/183 |
| 3,006,993 | 10/1961 | Barndt | 358/183 |
| 3,821,468 | 6/1974 | Busch | 358/183 |
| 4,356,511 | 10/1982 | Tsujimura | 358/182 |
| 4,760,531 | 7/1988 | Yasui et al. | 340/995 |

*Primary Examiner*—Alvin E. Oberley
*Assistant Examiner*—Amare Mengistu
*Attorney, Agent, or Firm*—Antonelli, Terry, Stout & Kraus

[57] ABSTRACT

In the case where a map is used as a figure upon vertical scrolling for enlarging or reducing a map having a predetermined accuracy, a map having a higher accuracy as well as a map having a less amount of graphic data are subjected to vertical scrolling so that the map having a lower accuracy or the less amount of data is displayed superposing on the map having the higher accuracy. Upon vertical scrolling, the speed of vertical scrolling is improved in such a manner that the brightness of one of the maps which is gradually reduced is decreased to an extent in which a positional relation of the one map with the other map which is gradually enlarged is not unrecognizable to an operator and the one map displayed with a predetermined size is erased from a display device when the brightness of the one map is decreased to zero. Even in the case where the above-mentioned vertical scrolling and horizontal scrolling are used in combination, the scrolling is made with an improved speed. In the case where a three-dimensional figure is to be subjected to horizontal scrolling, a two-dimensional version of the three-dimensional figure from which information of height is eliminated is subjected to visual-point conversion and the visual-point converted two-dimensional figure is used upon horizontal scrolling, thereby improving the speed of horizontal scrolling.

7 Claims, 11 Drawing Sheets

GRAPHIC DISPLAY METHOD

BACKGROUND OF THE INVENTION

The present invention relates to a method of scrolling a figure, such as a map on a display screen.

In a system in which a figure, such as a topographic map, a street map or the like, is stored as electrical information and is graphically displayed on a display device such as a CRT, it is known to continuously move a domain of the figure for display. Such an operation is called scrolling.

A system for scrolling a figure has been described by, for example, COMPUTER GRAPHICS written by J. D. Forly & A. VAN DAM and translated by Atsuyoshi IMAMIYA. In the described system, scrolling is carried out in such a manner that graphic data is stored in a frame memory of a graphic display device each time a portion of the figure to be displayed (or a domain of the figure for display) is changed, and the access to the frame memory attendant upon refreshing and the refreshing of a display screen or a graphic image are repeated.

Also, JP-A-62-180473 has disclosed a system in which scrolling is carried out in such a manner that a frame memory having a large capacity is provided and the whole of a certain picture is collectively stored in the large capacity frame memory even if it comprises a plurality of graphic files. It is a characteristic of this system that it permits scrolling in a way which is transparent to the limit of each figure area to a certain extent.

Further, JP-A-1-62769 has disclosed a system in which the amount of a figure as displayed is controlled by determining the number of hierachical levels of graphic data to be displayed in accordance with the data amount of graphic data which is present in a designated display domain. It is a characteristic of this system that it permits high-speed scrolling.

In each of the above-mentioned scrolling systems, a figure developed in the frame memory is displayed and scrolled. Accordingly, as the amount of data which comprises figure is increased, the time required for refreshing becomes long. In the system disclosed in JP-A-1-62769, the time for access to the frame memory is reduced by decreasing the number of figures to be displayed. Even in this system, however, the amount of data for a figure to be displayed becomes large when the domain of the figure for display is enlarged. This can be avoided by further decreasing the number of figures to be displayed. In that case, however, there arises an inconvenience that a figure the display of which is desired may be erased. Further, in this type of system, though it is important to provide the ability to effect high-speed scrolling, it is desired to make a graphic image upon scrolling and before and after scrolling easy for an operator to see. Also, it is desired to improve the operability upon scrolling.

SUMMARY OF THE INVENTION

An object of the present invention is to provide a graphic display method in which, when a figure having a predetermined accuracy is to be subjected to vertical scrolling, high-speed vertical scrolling can be attained by performing the vertical scrolling with the amount of graphic data being reduced by using a figure which is different in accuracy from the figure having the predetermined accuracy.

Another object of the present invention is to provide a graphic display method in which, when a three-dimensional figure is to be subjected to horizontal scrolling, high-speed horizontal scrolling can be attained in such a manner that a two-dimensional version of the three-dimensional figure from which data of height is eliminated is subjected to horizontal scrolling, and upon stopping of the horizontal scrolling, the data of height is given to the stopped two-dimensional figure.

Namely, in the case where a figure having a certain accuracy A is being displayed and a domain of the figure for display is enlarged by scrolling, data of a figure having an accuracy B lower than the accuracy A ($A>B$) is displayed by superposing the lower accuracy data on the figure of accuracy A when the display domain of the figure of accuracy A takes a certain size. And, the brightness of the data of accuracy A is gradually decreased in accordance with a predetermined function. In the case where the figure of accuracy B is being displayed and the display domain of the figure is reduced, the data of accuracy, A ($A>B$) is displayed by superposing the higher accuracy data on the figure of accuracy B when the display domain of the figure of accuracy B takes a certain size. The brightness of the figure or data of accuracy A is firstly set to a low value and is gradually increased in accordance with a predetermined function as the display domain of the figure of accuracy A is enlarged. Figures having different accuracies are not always stored in a frame memory, are registered into the frame memory as required, and are erased from the frame memory when not required.

In the case where a three-dimensional figure is to be displayed, visual-point (or point-of-sight) conversion is made to change the display form of graphic data so that information of height is displayed. When horizontal scrolling is to be carried out, the information of height is erased. The horizontal scrolling of graphic data is carried out in a state in which the information of height is erased. When the horizontal scrolling is completed, a three-dimensional representation is displayed.

The processing of gradually changing the brightness makes it possible to make a smooth interchange of a plurality of figures having different accuracies. Even if the display domain is enlarged, high-speed vertical/-horizontal scrolling can be attained since the amount of data of the figure of accuracy B is less as compared with the amount of data of the figure of accuracy A ($A>B$). In the case where a three-dimensional representation is to be displayed, visual-point conversion, such as oblique conversion, is effected to change the display form of graphic data so that information of height is displayed. When horizontal scrolling is to be performed, the three-dimensional representation is erased and two-dimensional graphic data having the changed display form is subjected to the horizontal scrolling. When the horizontal scrolling is completed, the three-dimensional representation is restored. In the case of a three-dimensional figure, since a two-dimensional version of the three-dimensional figure obtained by visual-point conversion thereof is subjected to horizontal scrolling, the horizontal scrolling of a three-dimensional representation can be performed smoothly and at high speed. Further, since the increase of the amount of data in the three-dimensional representation can be suppressed upon horizontal scrolling, the speed of horizontal scrolling can be improved.

The interchange of figures having different accuracies, the provision of a two-dimensional version of a three-dimensional figure and the visual-point conversion, as mentioned above, are carried out by calculating and setting each relevant parameter in accordance with the condition of a figure to be displayed. Therefore, the operability is improved.

DESCRIPTION OF THE PREFERRED EMBODIMENTS

Embodiments of the present invention will now be explained on the basis of the accompanying drawings.

First of all, scrolling will be explained for the purpose of giving easy understanding of the present invention. The scrolling of graphic data is performed as follows. Firstly, the graphic data is first stored into a frame memory of a display device. Thereafter, a refreshing operation is repetitively performed while updating a relation in correspondence between coordinates established on an electronic map corresponding to a map to be displayed on the display screen of a display device and coordinates on the display screen, and the access to data in the frame memory is made to convert the data into a video signal which is in turn displayed on the display device.

Figure 2A:
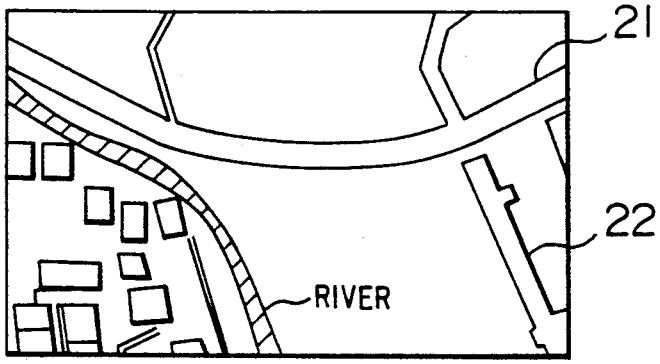
FIGS. 2A to 2C are views for explaining a specific example of horizontal scrolling in which a display domain is moved with the size thereof being unchanged.
Figure 2B:
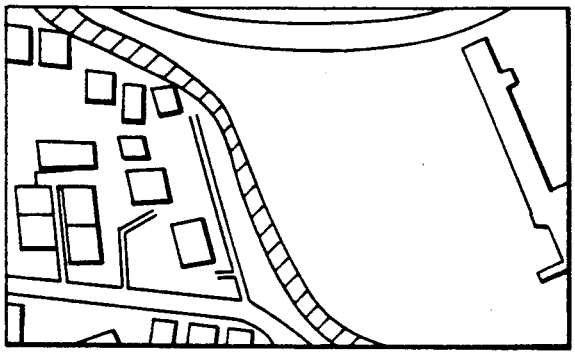
Figure 2C:
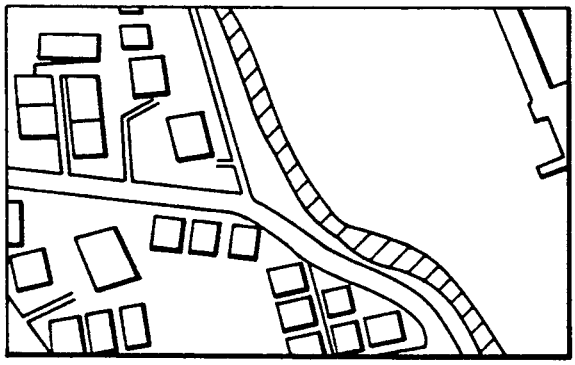

A scrolling method which may be generally considered involves an operation of moving a display domain of a figure (a domain of the figure to be displayed on the display screen of a display device), as shown in FIGS. 2A to 2C. In FIG. 2A, reference numeral 21 designates roads and numeral 22 designates architectures (houses, buildings and structures). Further, there is a scrolling method in which a figure is displayed while the magnification thereof is changed. In embodiments of the present invention, the scrolling as shown in FIGS. 2A to 2C corresponding to the movement of a display domain of a figure is called horizontal scrolling and the scrolling corresponding to the enlargement/reduction of the display domain is called vertical scrolling. If the vertical scrolling of a figure having a certain accuracy is continued, the amount of graphic data to be displayed on the display screen of a display device becomes large. Therefore, the amount of graphic data in a frame memory to be accessed becomes large, resulting in the lowering of the displaying speed and hence the speed of vertical scrolling. For such circumstances, there is proposed a method in which the figure is partially thinned out. However, in the case where a figure such as a map is handled, the proposed method needs to thin out a substantial amount of the figure, thereby giving rise to a problem that important graphic data may not be retained (or may be erased). In order to avoid this inconvenience, in the present embodiment, vertical scrolling is performed while making an interchange of a plurality of figures which have different accuracies. The term accuracy refers to the more or less amount of information (or graphic data) necessary for displaying a figure. For example, in the case of topographic maps, the accuracy of a map having dense contour lines is high and the accuracy of a map having coarse contour lines is low. Also, there may be the case where a figure is displayed on the display screen with a changed form of the figure. For example, a map in which houses or buildings are individually shown has a high accuracy and a map in which a city is designated by a rectangle as a whole has a low accuracy. Thereby, it is possible to reduce the amount of graphic data while retaining important information without eliminating or erasing it.

Next, an embodiment of the present invention will be explained referring to FIGS. 1A to 1C which show graphic images used in an embodiment of vertical scrolling. The illustrated example relates to a map. In the present embodiment, when a figure of accuracy A as shown in FIG. 1A which contains a relatively large amount of graphic data is vertically scrolled, the speed of vertical scrolling is improved by using a figure of accuracy B which contains an amount of graphic data which is less than that of the figure of accuracy A.

Figure 1A:
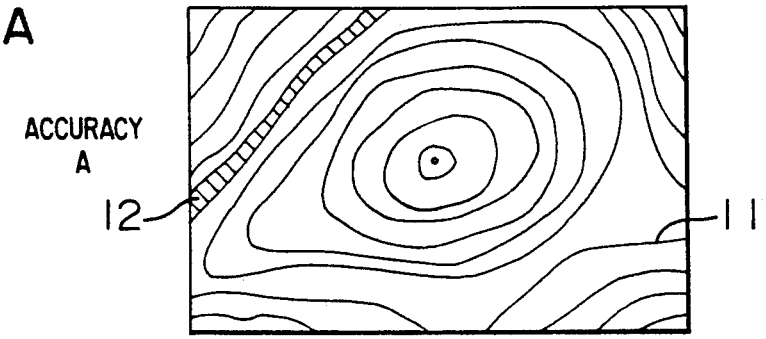
FIGS. 1A to 1C show a specific example of figure images included when vertical scrolling including the enlargement of a display domain is made in conjunction with an embodiment of the present invention in which a plurality of figures having different accuracies are used.

Assume that the figure of accuracy A is displayed on a display device (FIG. 1A). The vertical scrolling is centered around a visual point (or point of sight) of the figure of accuracy A (or the center of the display screen area of a display device in the illustrated example). Graphic data of the figure of accuracy A is stored in a frame memory. A domain of the figure of accuracy A to be displayed on the display screen is enlarged. Just before the display domain of the figure of accuracy A, the graphic data of which has been stored in the frame memory, falls within the display (screen) area of the display device, graphic data of the figure having an accuracy B lower than the accuracy A is transferred into the frame memory. At a point of time when a display domain of the figure of accuracy B exceeds the display domain of the graphic data of the figure of accuracy A, the figure of accuracy B is superimposed on the figure of accuracy A (see FIG. 1B).

After the figure of accuracy B has been displayed, the brightness of the figure of accuracy B is increased while the brightness of the figure of accuracy A is decreased. At this time, the figure of accuracy A and the figure of accuracy B may have portions which do not strictly overlap each other and/or there may be portions which appear in the figure of accuracy A but do not appear in the figure of accuracy B. However, this offers no problem since those figure portions become invisible finally because of the decrease in brightness of the figure of accuracy A as the display domain of the figure of accuracy B is enlarged.

Figure 1B:
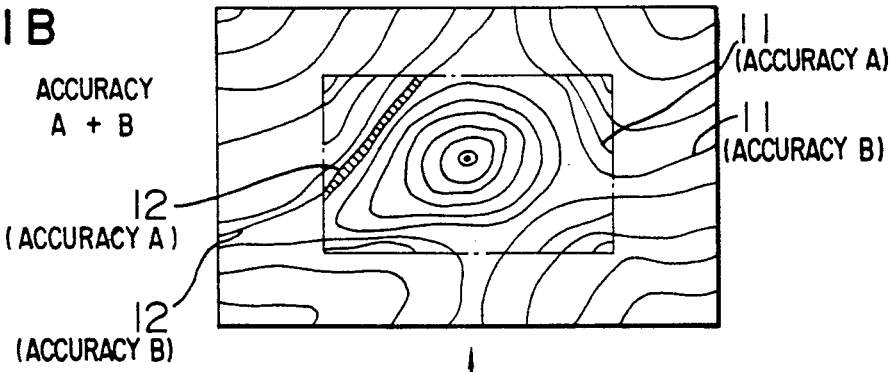
Figure 1C:
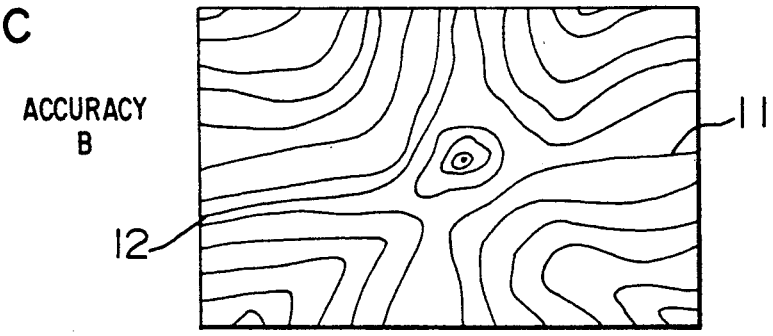

When the display area or size of the figure of accuracy A becomes equal to or smaller than a predetermined proportion (for example, one half) of the display area of the display device, the graphic data of the figure of accuracy A is erased from the display screen (see FIG. 1C). The graphic data of the figure of accuracy A is erased from the frame memory. In this manner, only the figure of accuracy B is ultimately displayed.

A graphic image shown in FIG. 1A includes contour lines 11 and a river 12 represented in the figure of accuracy A. However, in a graphic image of the figure of accuracy B shown in FIG. 1C, the contour lines 11 are displayed in a thinned-out form and the river 12 is displayed with a pattern changed from a two-stripe representation to a single-stripe representation. Similarly, for example, a city is displayed with a pattern representing individual houses when a figure having a high accuracy is displayed but the city is displayed with a pattern represented by a frame when a figure having a low accuracy is displayed. Since the figure of accuracy A and the figure of accuracy B are simultaneously displayed in FIG. 1B, the amount of graphic data is temporarily increased. However, in FIG. 1C, as result of vertical scrolling, only the figure of accuracy B is displayed. Namely, since the result of vertical scrolling is displayed with the figure of accuracy B, the amount of graphic data is reduced in comparison with the case where the figure of accuracy A is displayed with the same display domain in place of the figure of accuracy B. Thereby, it is possible to improve the speed of vertical scrolling which is performed from FIG. 1A toward FIG. 1C. Vertical scrolling of a plurality of figures having different accuracies can be made smoothly by gradually decreasing the brightness of the figure of accuracy A while gradually increasing the intensity of the figure of accuracy B. During the above procedure, an operator is only requested to perform a usual operation of enlarging the display domain of the figure of accuracy B by use of an I/0 device such as a keyboard. A necessary control is written in a program as an algorithm.

Figure 10:
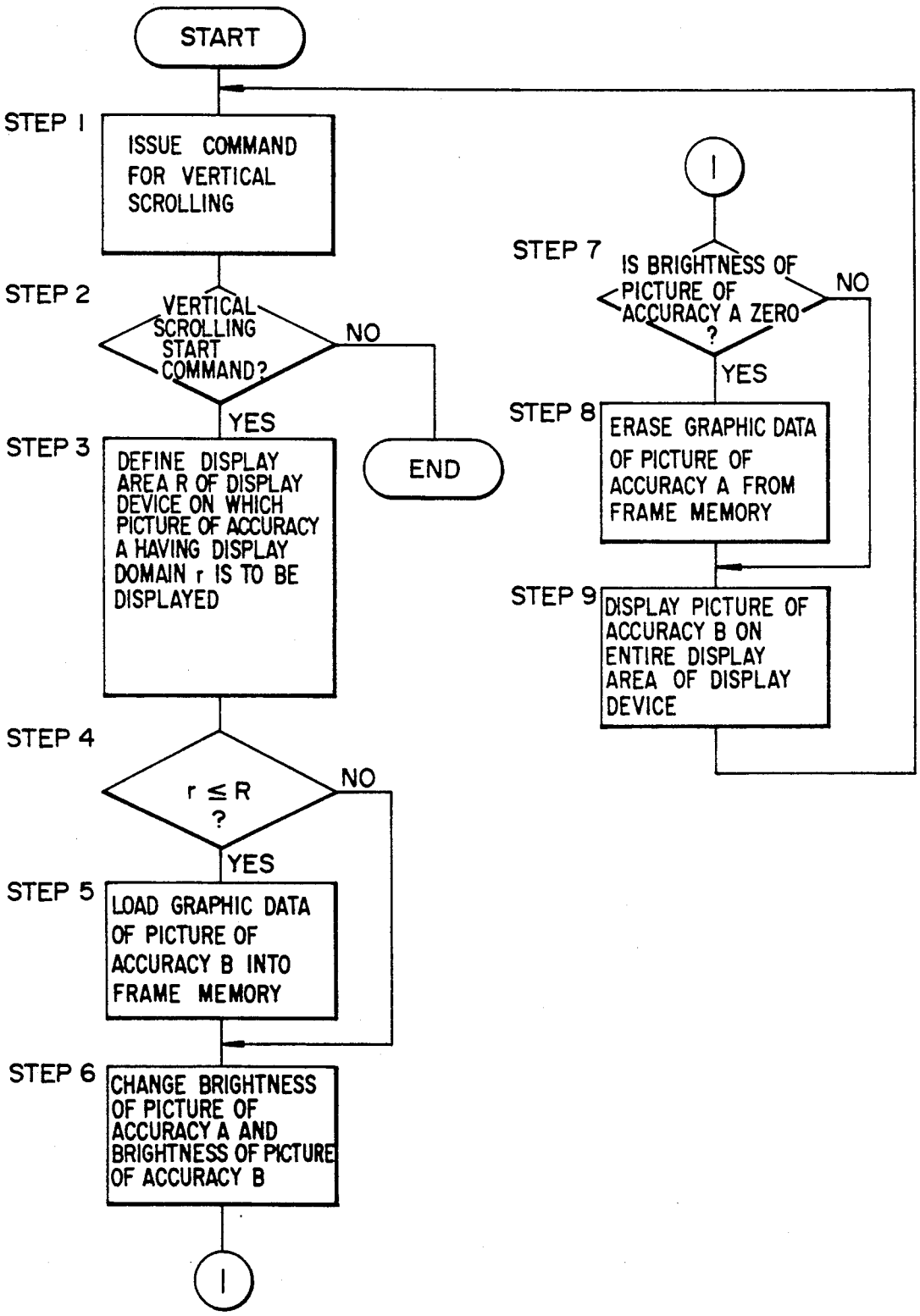
FIG. 10 is a flow chart showing the operation of the vertical scrolling shown in FIGS. 1A to 1C.

An algorithm for performing vertical scrolling to enlarge the display domain of a figure will now be explained by virtue of FIG. 10. In step 1, a command for vertical scrolling is issued. In step 2, if the command for vertical scrolling is a vertical scrolling end command, the vertical scrolling is finished. If the command for vertical scrolling is not the vertical scrolling end command or is a vertical scrolling start command, the processing goes to step 3. In step 3, vertical scrolling is started so that an area R of display on a display device for a figure of accuracy A to be displayed on the display device is defined and the figure of accuracy A preliminarily loaded as graphic data in a frame memory is displayed on the display device. The graphic data of the figure of accuracy A has a predetermined display domain r. In the present embodiment, the display area R of the display device can be regarded as being the display screen shown in FIG. 1A. At a point of time when the figure of accuracy A is displayed on the display device, R is equal to r.

In step 4, the display domain of the graphic data of the figure of accuracy A and the display area R of the display device are compared with each other. On the display device, r is equal to R just before the vertical scrolling is started and r becomes smaller than R just after the vertical scrolling has been started. The relation of $r<R$ is satisfied just after the vertical scrolling has been started so that the size of the figure of accuracy A on the display device is gradually decreased. If $r \leqq R$ is satisfied as the result of comparison in step 4, the processing goes to step 5. If $r \leqq R$ is not satisfied, the processing goes to step 6.

In step 5, graphic data of a picture having an accuracy B lower than the accuracy A is transferred or loaded into the frame memory from, for example, an external device such as a disk. At this time, the figure of accuracy B is displayed on the display device. Through the vertical scrolling, the figure of accuracy A becomes gradually small toward a point of sight (or a visual point) and the figure of accuracy B becomes gradually large with the decrease of the figure of accuracy A.

In step 6, the brightness of the figure of accuracy A is gradually decreased and the brightness of the figure of accuracy B is gradually increased.

In step 7, the judgement is made of whether or not the brightness of the figure of accuracy A becomes zero (that is, the figure of accuracy A becomes invisible). The processing goes to step 8 in the case where the brightness is zero and step 9 in the case where the brightness is not zero.

In step 8, since the figure of accuracy A is no longer necessary, the graphic data of the figure of accuracy A is erased from the frame memory. Namely, the figure of accuracy A is erased from the display screen. As has already been mentioned, the erasing is realized, for example, by decreasing the brightness of the figure of accuracy A to zero when the size of display of the figure of accuracy A becomes a half of the display area R of the display device during execution of the vertical scrolling.

In step 9, the figure of accuracy B is displayed on the entire display area R of the display device. If the next vertical scrolling is to be made, the processing is returned to step 1.

By thus using the figure having the low accuracy B instead of vertically scrolling the figure having the high accuracy A, the speed of vertical scrolling can be improved since the amount of graphicy data for the figure of accuracy B is less than that for the figure of accuracy A.

Figure 3:
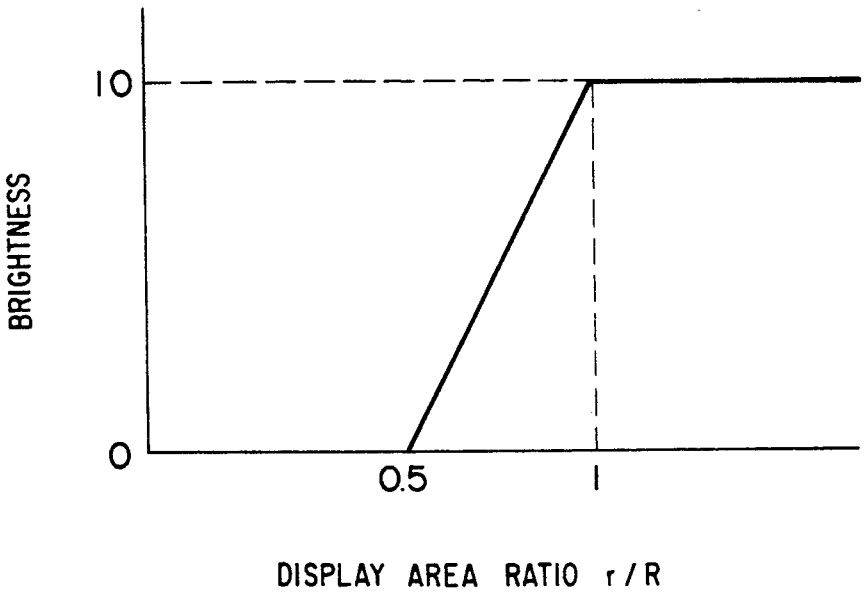
FIG. 3 is a graph illustrating a specific example of a function which shows a relationship between the brightness and the display area ratio.

FIG. 3 shows a relationship between the brightness and the display area ratio r/R upon vertical scrolling. In a graph shown in FIG. 3, the abscissa represents the display area ration r/R and the coordinate represents the brightness. This graph shows that the timing for erasing of the graphic data of the figure of accuracy A can be expedited in such a manner that the size of the figure of accuracy A when the brightness of the figure of accuracy A is decreased to zero is selected to an extent in which the figure of accuracy A gradually reduced upon vertical scrolling is not hard for the operator to recognize in a positional relation with the figure of accuracy B. This also contributes to the improvement of the speed of vertical scrolling. For example, if it is desired to expedite the timing for erasing of the figure of accuracy A which is gradually reduced through the vertical scrolling, the characteristic line shown in FIG. 3 will assume a line resembling to the ordinate or have a larger gradient. On the other hand, if it is desired to erase the figure of accuracy A at a point of time when the size of the figure of accuracy A is made as small as possible, the characteristic line will assume a line resembling to the abscissa or have a smaller gradient.

Vertical scrolling as mentioned above can also be used in the case where the display domain cf a figure is to be reduced. Such an operation becomes necessary when the return to the original state is desired after vertical scrolling has been completed or when it is desired to display a natural or instrinsic graphic image in the course of vertical scrolling. In this case, a processing of steps reverse to the above-mentioned steps is performed. Namely, assume that the figure of accuracy B is being displayed (FIG. 1C). Graphic data for this figure of accuracy B is stored in the frame memory. The display domain of the graphic data for the figure of accuracy B is reduced. When the size of the figure of accuracy B becomes a certain proportion of the display area R of the display device, graphic data for the figure of accuracy A is stored into the frame memory and is displayed on the display device (FIG. 1B). At this time, the brightness of the graphic data for the figure of accuracy A has a low value according to the relation shown in FIG. 3 since the value of r/R is small. When the display domain r of the figure of accuracy A becomes equal to the display area R of the display device, the brightness of the figure of accuracy A is restored (FIG. 1A). At this time, the graphic data for the figure of accuracy B is erased from the frame memory. Ultimately, only the figure of accuracy A is thus displayed on the display device.

Figure 4:
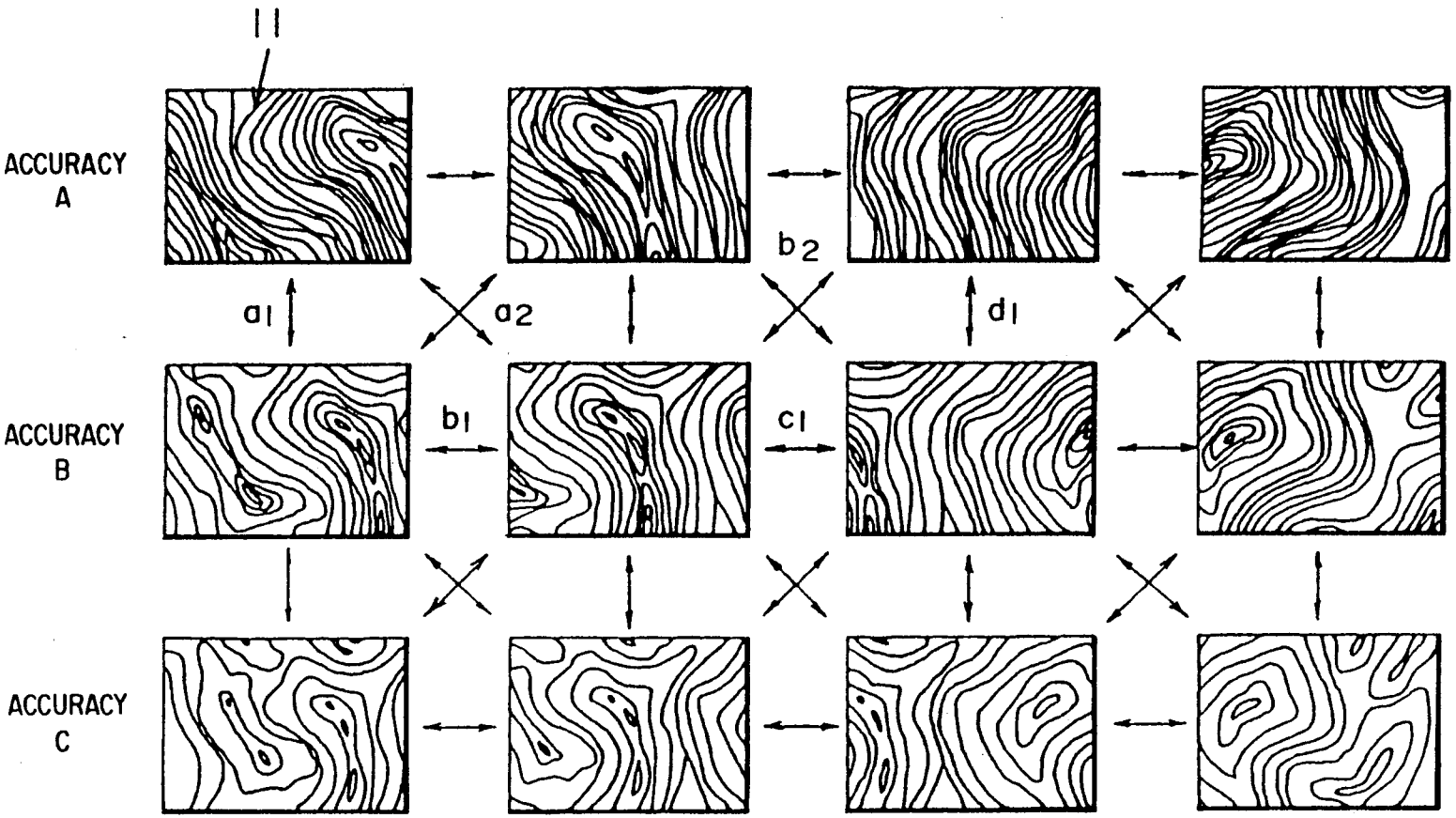
FIG. 4 is a view for explaining an embodiment of vertical/horizontal scrolling taught by the present invention.

A relationship between vertical scrolling and horizontal scrolling is shown in FIG. 4. A topographic map is therein shown as an example. It is seen that contour lines are thinned out as scrolling is advanced from a figure of high accuracy toward a figure of low accuracy (that is, with the advance of accuracy A→accuracy B→accuracy C). In FIG. 4, an arrow in a horizontal direction denotes horizontal scrolling and an arrow in a vertical direction denotes vertical scrolling. For the purpose of the improvement of the degree of freedom of an operator's manipulation and the shortening of a scrolling time, the execution of separate horizontal and vertical scrollings in a separative manner shown by an arrow sequence of $a_l \rightarrow b_l \rightarrow c_l \rightarrow D_l$ does not suffice and it is necessary to perform horizontal scrolling with vertical scrolling being performed. The latter is shown by an arrow sequence of $a_2 \rightarrow b_2$.

Figure 5A:
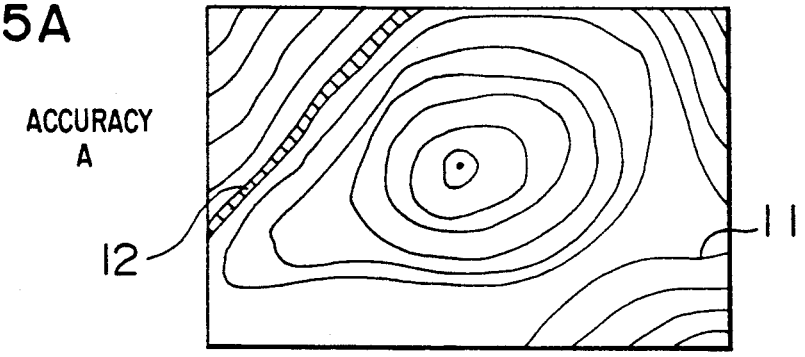
FIGS. 5A to 5C are views for explaining a specific example of graphic images included when vertical scrolling and horizontal scrolling are made simultaneously.
Figure 5B:
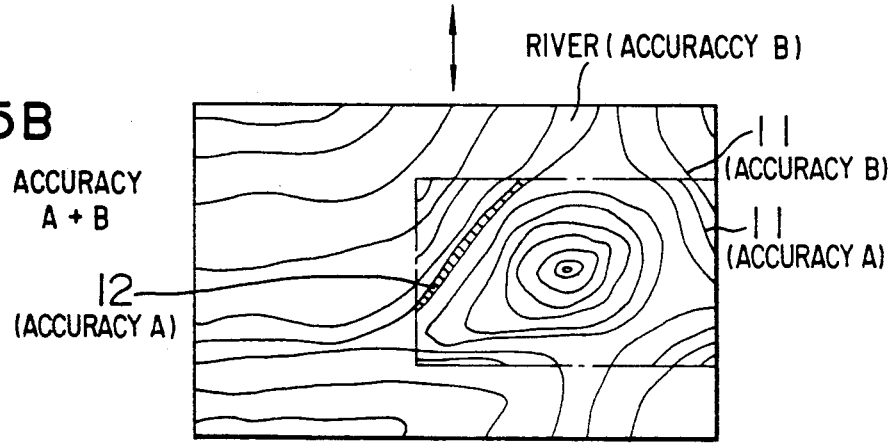
Figure 5C:
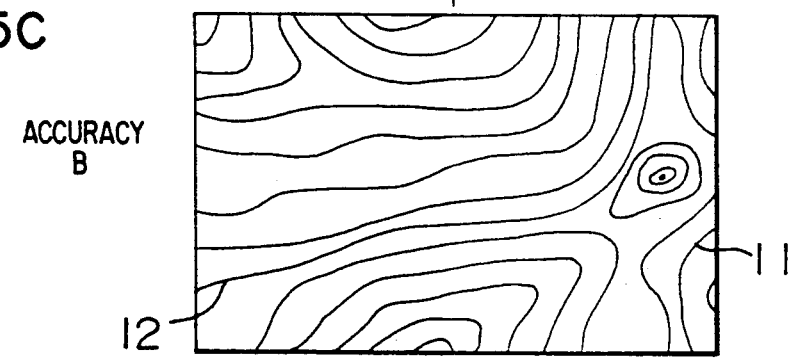

FIGS. 5A to 5C show actual picture images as displayed when scrolling is performed in accordance with the arrow sequence of $a_2 \rightarrow b_2$. A change from FIG. 5A to FIG. 5B corresponds to the arrow $a_2$ shown in FIG. 4 and a change from FIG. 5B to FIG. 5C corresponds to the arrow $b_2$ shown in FIG. 4. Scrolling in an oblique direction as $a_2$ or $b_2$ shown in FIG. 4 is called cross scrolling. By performing the cross scrolling, a wide area or domain can be displayed by a figure of accuracy B, as shown in FIG. 5C. Accordingly, the vertical scrolling is effective when it is desired to obtain a desired display by rapidly scrolling a wide area.

In the embodiment shown in FIGS. 1A to 1C, vertical scrolling is made with a predetermined visual point as the center. In the embodiment shown in FIGS. 5A to 5C, a visual point when vertical scrolling is performed is moved or vertical scrolling and horizontal scrolling are made together.

Figure 6:
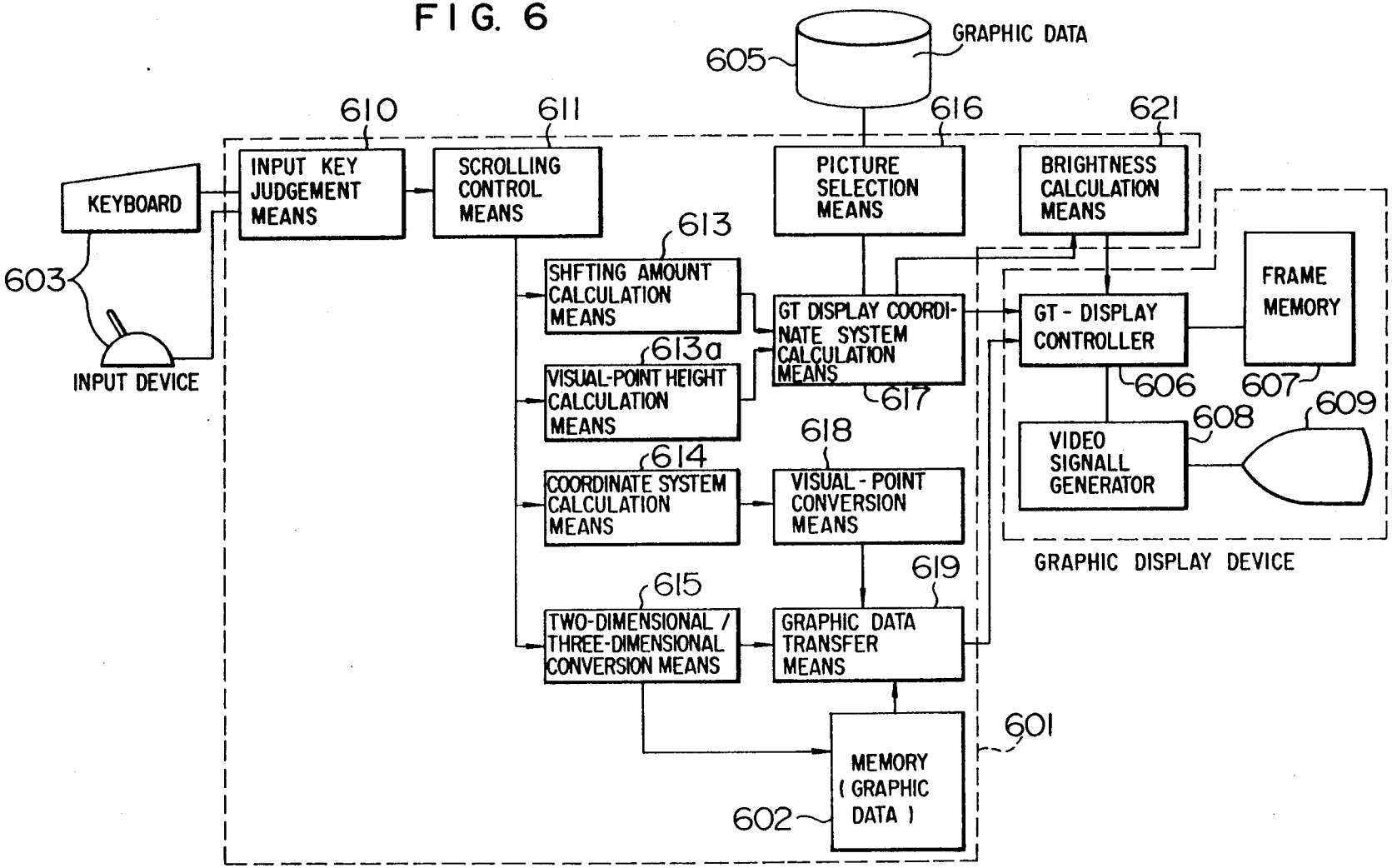
FIG. 6 is a block diagram showing the construction of a system for performing scrolling.

An example of the construction of a system for realizing the present invention is shown in FIG. 6. A computer 601 is provided with a scrolling control means 611 which determines a direction of scrolling by interpreting a control signal coming from I/O devices 603 including a keyboard, a mouse, a joystick and so on by means of an input key judgement means 610 and makes the overall control including the transfer of graphic data on a frame memory. A scroll program and graphic data are stored in a memory 602. Graphic data is stored in an external data storage 605 and is fetched therefrom as required. Graphic data is stored into a frame memory 607. Under control of a graphic controller 606, graphic data for a necessary domain is converted into a video signal by a video signal generator 608 and is displayed on a display device 609. The computer 601 is further provided with well known means which include a shifting amount calculation means 613, a visual-point height calculation means **613*a*, a coordinate system calculation means 614, a two-dimensional/three-dimensional conversion means 615, a figure selection means 616, a GT display coordinate system calculation means 617, a visual-point conversion means 618, a graphic data transfer means 619 and a brightness calculation means 621**.

Figure 7A:
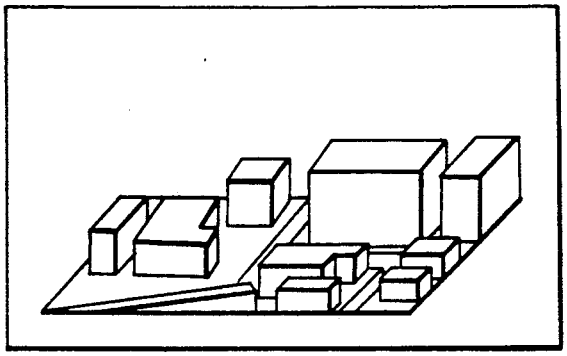
FIGS. 7A to 7C are views for explaining an embodiment of horizontal scrolling associated with a three-dimensional representation.
Figure 7B:
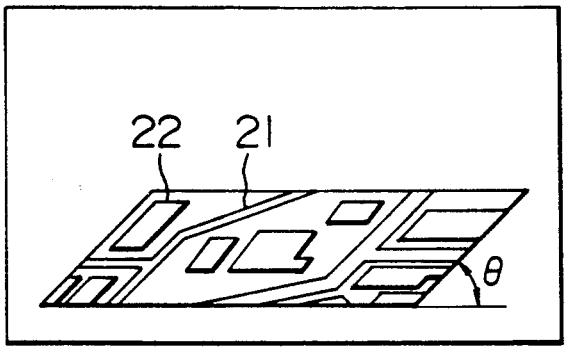
Figure 7C:
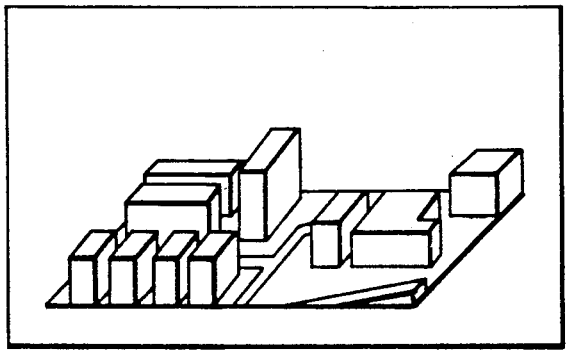
Figure 8:
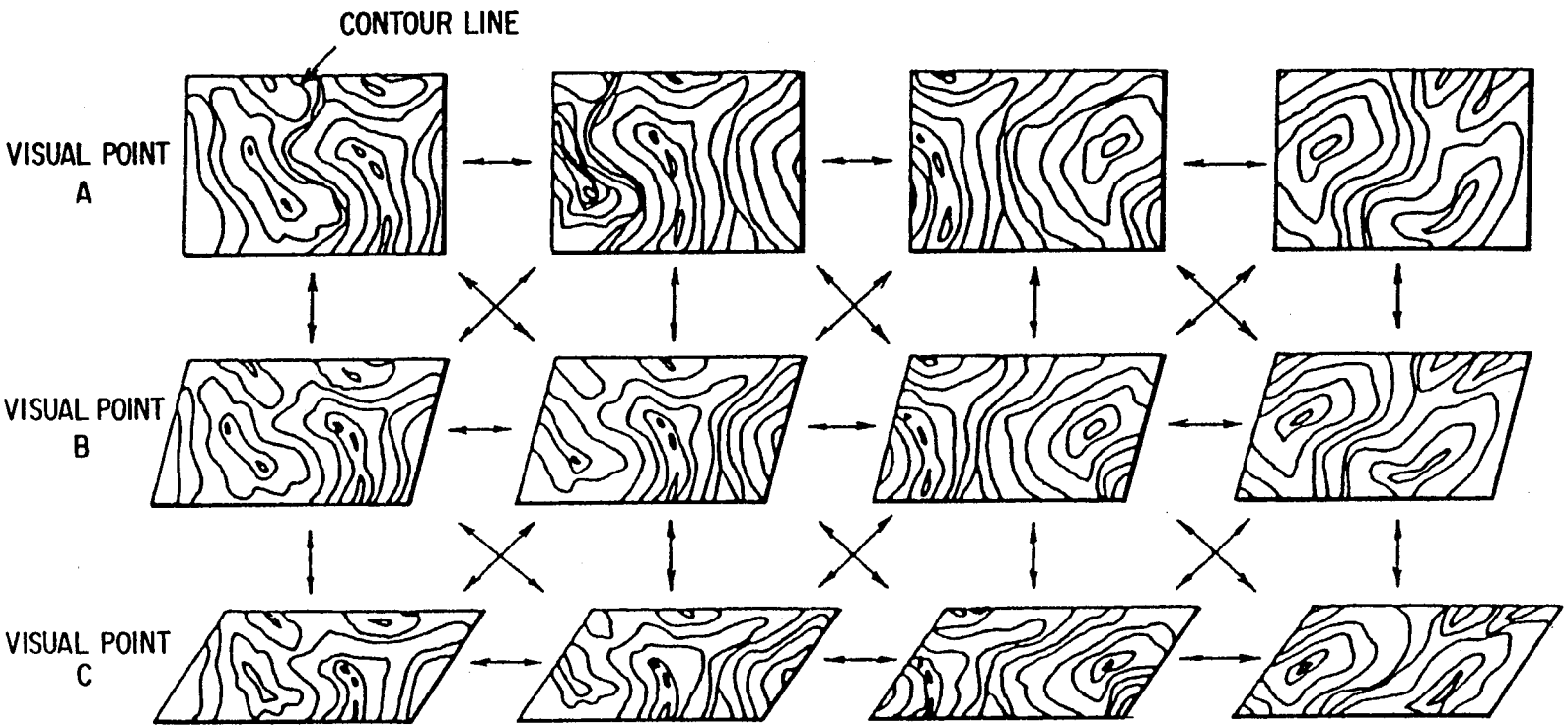
FIG. 8 is a view for explaining horizontal scrolling after visual-point conversion.
Figure 9A:
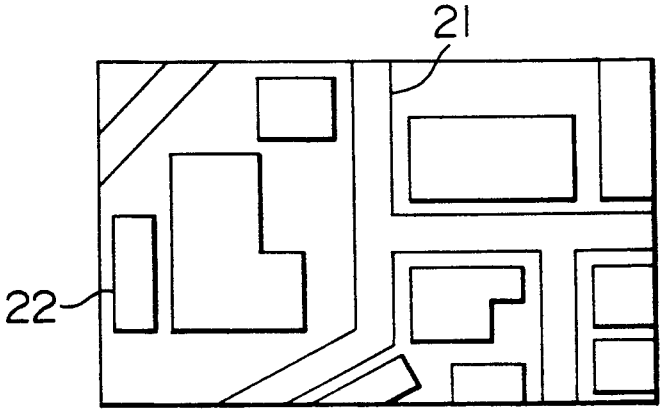
FIGS. 9A to 9C are views for explaining another horizontal scrolling after visual-point conversion.
Figure 9B:
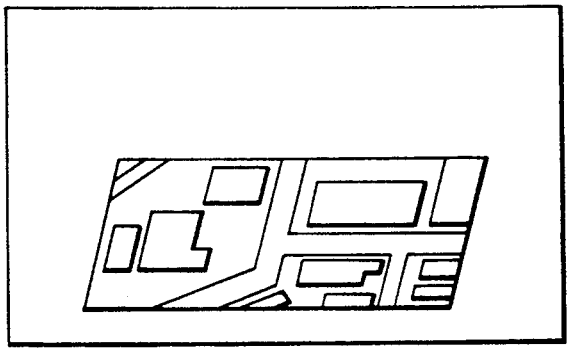
Figure 9C:
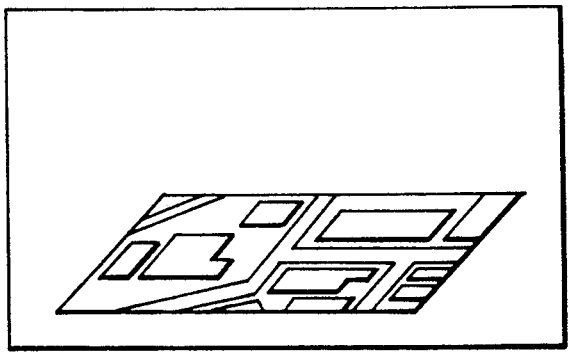

Next, explanation will be made of horizontal scrolling of a three-dimensional figure the graphic data of which has information of height. A house map to be subjected to horizontal scrolling is shown in FIGS. 7A to 7C. In FIG. 7A showing a state just before the horizontal scrolling is started, graphic data of architectures are displayed three-dimensionally. In FIG. 7B showing a state in which the horizontal scrolling is being made, three-dimensional graphic data of architectures 22, river 21, etc. is erased and a two-dimensionally represented map is displayed. In this state, horizontal scrolling as mentioned above is performed. FIG. 7C shows a state in which the horizontal scrolling in FIG. 7B is stopped and a three-dimensional representation is restored in the domain of display after the horizontal scrolling. Thus, in the present embodiment, no three-dimensional representation is made upon horizontal scrolling but the horizontal scrolling is made with a graphic representation of the topographic or house map in a height direction being eliminated. If the horizontal scrolling is made with the three-dimensional representation, there arises a problem that the speed of horizontal scrolling is lowered since the amount of graphic data to be displayed becomes large. Therefore, in the present embodiment, the horizontal scrolling is made with the representation of information of height being eliminated and the completion of the horizontal scrolling is followed by restoring the three-dimensional graphic data to the two-dimensional figure upon completion of the horizontal scrolling. Thereby, the speed of horizontal scrolling of a three-dimensional figure is improved. The present embodiment can be applied to, for example, the horizontal scrolling of a two-dimensional figure having color-coded map information. Namely, the speed of horizontal scrolling can be improved by performing the horizontal scrolling after the color information has been eliminated. When the horizontal scrolling of a two-dimensional version of a three-dimensional figure in which information of height is eliminated is to be made, it is necessary to establish a visual point of the two-dimensional figure. A method of establishing the visual point may include oblique conversion and perspective conversion. The oblique conversion refers to an operation of giving a squint appearance to a two-dimensional figure and the operation includes determining a visual point by establishing an angle $\theta$ shown in FIG. 7B. The perspective conversion refers to an operation of giving a point at infinity to a two-dimensional figure so that the two-dimensional figure as displayed has a perspective or scenographic appearance. The oblique or perspective conversion can be realized by transforming coordinates of the two-dimensional figure. The coordinate transformation can be established freely in accordance with a selected parameter (the above-mentioned angle $\theta$ or point at infinity). Thereby, a change in three-dimensional appearance is made so that portions hidden from sight become visible. FIG. 8 shows an example of the oblique conversion and FIGS. 9A and 9C show examples of graphic images displayed when oblique conversion is continuously made. In the present embodiment, such scrolling as shown is called visual-point scrolling. As another example of visual-point conversion, there may be employed a method in which scrolling is made after a figure has been rotated and subjected to perspective conversion.

Figure 11:
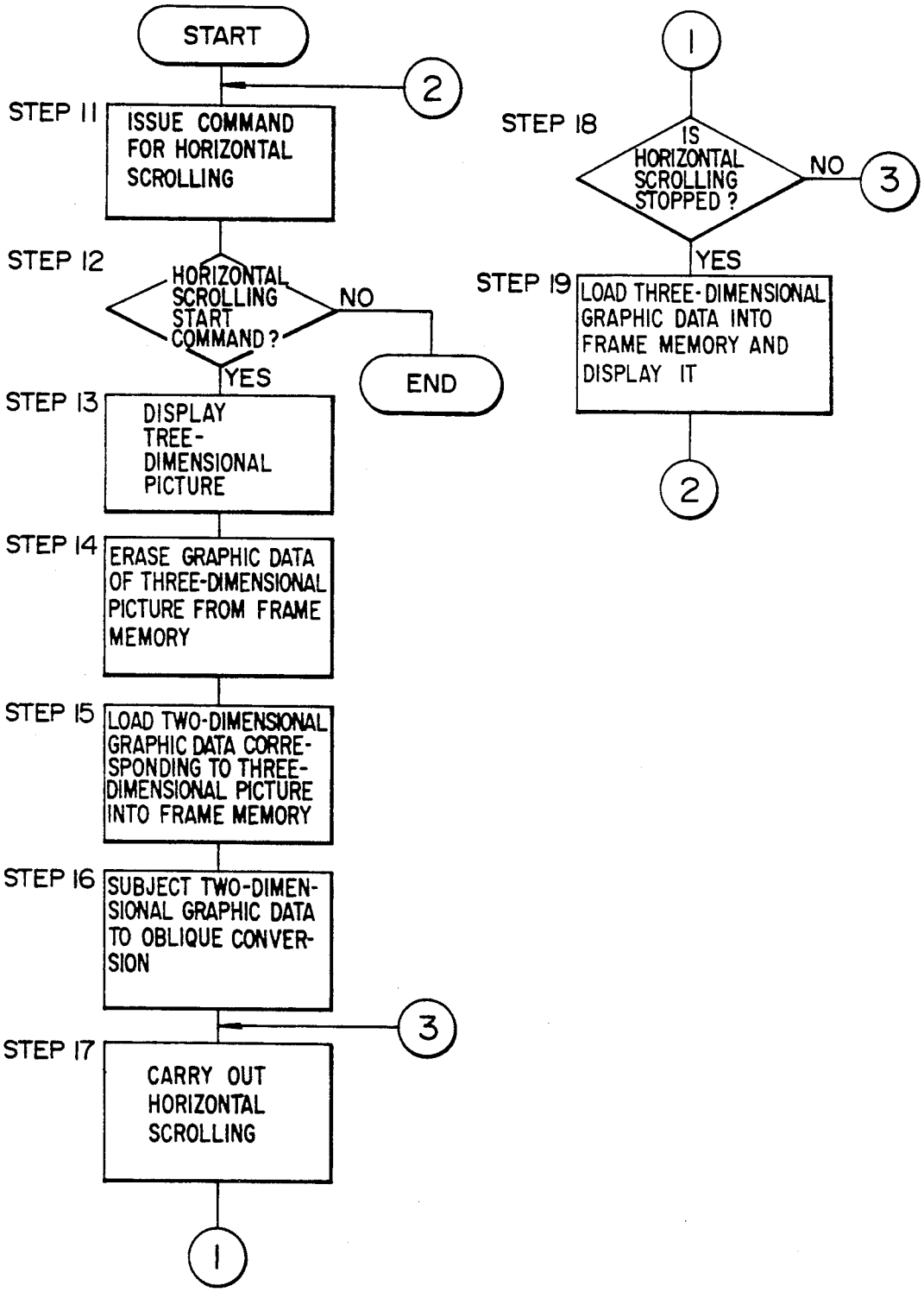
FIG. 11 is a flow chart showing the operation of the horizontal scrolling shown in FIGS. 7A to 7C.

Next, a method of providing a three-dimensional representation in a static state and a two-dimensional representation in a scrolling state will be explained by virtue of FIGS. 7A to 7C. In the static state, graphic data of a two-dimensional map and graphic data of a three-dimensional appearance are separately registered in a frame memory. The three-dimensional graphic data is produced through calculation in a computer based on the two-dimensional graphic data and graphic data of height. During horizontal scrolling, the three-dimensional graphic data is erased from the frame memory and the two-dimensional graphic data in the frame memory is accessed and displayed on a display device. In a state in which the three-dimensional graphic data is to be displayed, the three-dimensional graphic data is calculated and produced from the two-dimensional graphic data, and the graphic data of height, is transferred into a three-dimensional data area of the frame memory and is displayed on the display device. This algorithm will now be explained by reference to FIG. 11. Assume that the initial graphic display state on a display device is a state shown in FIG. 7A. In step 11, a command for horizontal scrolling is issued. This command is inputted from, for example, a keyboard.

In step 12, if the command for horizontal scrolling is a start command, the processing goes to step 13. If the command for horizontal scrolling is not the start command, the horizontal scrolling is finished.

In step 13, a three-dimensional figure to be subjected to horizontal scrolling is displayed on a display device. In step 14, graphic data of the three-dimensional figure is erased from a frame memory. Namely, the three-dimensional figure is erased from the display screen.

In step 15, two-dimensional graphic data corresponding to the erased three-dimensional figure is loaded into an area of the frame memory from another area thereof. In step 16, the two-dimensional graphic data is subjected to oblique conversion. In step 17, horizontal scrolling is carried out.

In step 18, the judgement is made of whether or not the horizontal scrolling is stopped. If the horizontal scrolling is stopped, the processing goes to step 19. If the horizontal scrolling is not stopped, the processing is returned to step 17 to continue the horizontal scrolling.

In step 19, since the horizontal scrolling is stopped, three-dimensional graphic data corresponding to a two-dimensional figure displayed on the display device at a point of time of stopping of the horizontal scrolling is loaded into the frame memory and is displayed on the display device. And, the processing is returned to step 11 in order to perform the next horizontal scrolling.

It can be easily understood that cross scrolling using the combination of visual-point scrolling and horizontal scrolling or synthetic scrolling using the combination of visual-point scrolling, horizontal scrolling and vertical scrolling (and three-dimensional representation) can be realized by combining the methods of FIGS. 5A to 5C and FIGS. 7A to 7C, thereby making it possible to improve the speed of scrolling.

According to the present invention, vertical/ horizontal scrolling through a plurality of graphic data having different accuracies is possible. Further, since the amount of graphic data upon scrolling can be controlled, the speed of scrolling is not lowered even if the size of a display area to be scrolled is enlarged. Also, even in the case where a three-dimensional representation is accompanied, the reduction of the amount of graphic data and the improvement of the speed of horizontal scrolling can be attained since during horizontal scrolling a two-dimensional representation is made with the three-dimensional representation being erased.

We claim:

1. A graphic display method in which graphic data displayed on a display screen may be scrolled in scale and/or position, the method comprising the steps of:

displaying a first figure of said graphic data on the display screen with a first scale;

loading graphic data of a second figure of said graphic data which is different in accuracy from said first figure and has a different scale into a frame memory when a display domain of said first figure occupies a predetermined size relative to a display area of said display screen;

displaying said second figure, while synchronizing the display of said second figure with the display of said first figure, on a display area portion of said display screen which is left when said first figure is reduced around a visual point of said first figure, as said first figure is subjected to vertical scrolling with said central visual point of said first figure as the center;

gradually decreasing the brightness of said first figure relative to the brightness of said second figure, while synchronizing the scrolling of said first figure with said second figure, as the size of display of said first figure and the size of display of said second figure are gradually reduced and enlarged, respectively, by the vertical scrolling;

erasing rom said display screen said first figure which has a predetermined size when the brightness of said first figure occupies a predetermined brightness; and displaying said second figure on the entire display area of said display screen.

2. A graphic display method according to claim 1, wherein the size of said first figure erased from said display screen when the brightness of said first figure occupies said predetermined brightness is varied while synchronizing the scrolling of said first figure with said second figure.

3. A graphic display method comprising the steps of:

displaying a figure of accuracy A on a display screen with a visual point of said figure of accuracy A at the center of the screen;

when said figure of accuracy A is to be subjected to vertical scrolling so that it is enlarged in scale, loading graphic data of a figure having an accuracy B lower than the accuracy of said figure of accuracy A into a frame memory at a point of time when the display domain of the graphic data of said figure of accuracy A becomes smaller than the display area of said display screen, thereby displaying the graphic data of said figure of accuracy B on a display area portion of said display screen which is left when said figure of accuracy A is reduced around said central visual point thereof;

gradually decreasing the brightness of said figure of accuracy A and gradually increasing the brightness of said figure of accuracy B as the area of said figure of accuracy A and the area of said figure of accuracy B are gradually reduced and enlarged, respectively, on said display screen by the vertical scrolling;

erasing from said display screen the display of said figure of accuracy A which has a predetermined size relative to said figure of accuracy B when the brightness of said figure of accuracy A is reduced to zero; and displaying said figure of accuracy B on the entire display area of said display screen.

4. A graphic display method comprising the steps of:

displaying a figure of accuracy B on a display screen with a visual point of said figure of accuracy B at the center of the screen;

when said figure of accuracy B is to be subjected to vertical scrolling so that it is reduced, loading graphic data of a figure having an accuracy A higher than the accuracy of said figure of accuracy B into a frame memory at a point of time when a display domain which graphic data of said figure of accuracy B has become smaller than a display area of said display screen, thereby displaying the graphic data of said figure of accuracy A on a display area portion of said display screen which is left around said central visual point when said figure of accuracy B is reduced;

gradually decreasing the brightness of said figure of accuracy B and gradually increasing the brightness of said figure of accuracy A as the area of said figure of accuracy A and the area of said figure of accuracy B are gradually enlarged and reduced, respectively, on said display screen by the vertical scrolling;

erasing from said display screen the display of said figure of accuracy B which has a predetermined size brightness of said figure of accuracy B is reduced to zero; and displaying said figure of accuracy A on the entire display area of said display screen.

5. A graphic display method in which a three-dimensional figure displayed on a display device is subjected to horizontal scrolling, the method comprising the steps of:

displaying a three-dimensional figure on the display device;

erasing graphic data of said three-dimensional figure from a frame memory;

loading two-dimensional graphic data corresponding to the erased three-dimensional figure into said frame memory;

subjecting said two-dimensional graphic data to visual-point conversion and displaying it on said display device;

subjecting the visual-point converted two-dimensional graphic data to horizontal scrolling;

erasing, from said frame memory, graphic data of a two-dimensional figure when the horizontal scrolling is stopped; and loading graphic data of a three-dimensional figure corresponding to the erased two-dimensional graphic data into said frame memory, thereby displaying the three-dimensional graphic data on said display device.

6. A graphic display method according to Claim 5, wherein said visual-point conversion includes giving a visual point to the two-dimensional figure to convert the two-dimensional figure into a squint representation.

7. A graphic display method according to Claim 5, wherein said visual-point conversion includes giving the position of a point at infinity to the two-dimensional figure to convert the two-dimensional figure into a scenographic representation.

* * * * *